United States Patent [19]

Lutz

[11] Patent Number: 4,494,782

[45] Date of Patent: Jan. 22, 1985

[54] DRIVE DEVICE FOR A FASTENING MECHANISM OF A MOTOR VEHICLE DOOR LOCK OR THE LIKE

[75] Inventor: Manfred Lutz, Schweinfurt, Fed. Rep. of Germany

[73] Assignee: Fichtel & Sachs AG, Schweinfurt, Fed. Rep. of Germany

[21] Appl. No.: 478,441

[22] Filed: Mar. 24, 1983

[30] Foreign Application Priority Data

Mar. 25, 1982 [DE] Fed. Rep. of Germany ..... 3210924

[51] Int. Cl.[3] ..... E05C 3/14

[52] U.S. Cl. ..... 292/96

[58] Field of Search ..... 292/96, 1, 347, 336.3, 292/201

[56] References Cited

U.S. PATENT DOCUMENTS 3,321,226 5/1967 DeClaire et al. ..... 292/201 X 4,315,649 2/1982 Lutz ..... 292/201

FOREIGN PATENT DOCUMENTS 2847589 11/1978 Fed. Rep. of Germany .

*Primary Examiner*—Richard E. Moore

*Attorney, Agent, or Firm*—Toren, McGeady and Stanger

[57] ABSTRACT

The drive device for a locking mechanism of a motor vehicle door lock which can be fastened by means of a central locking installation comprises an operating element which is guided on a housing for linear displacement between a fastening position and an unfastening position and is coupled with the fastening mechanism. A motor drives the operating element in both directions of displacement. A locking lever mounted on the housing for pivoting about a spindle extending transversely of the direction of displacement of the operating element in its locking position blocks the operating element when it is situated in the fastening position. Thus the fastening mechanism in the locked condition cannot be unfastened manually. The locking lever is pivoted by a rotating drive through an eccentric. The eccentric engages in an aperture of the locking lever. The aperture permits a pivoting movement of the eccentric of more than 180°, while a stop face of the aperture limits the range of rotation of the eccentric. The end positions of the eccentric are situated, both in the locking position and in the unlocking position of the locking lever in a "beyond-dead-point-position", so that the locking device holds the locking lever in self-locking manner.

14 Claims, 10 Drawing Figures

DRIVE DEVICE FOR A FASTENING MECHANISM OF A MOTOR VEHICLE DOOR LOCK OR THE LIKE

SUMMARY OF THE INVENTION

The invention relates to a drive device for a fastening mechanism of a motor vehicle door lock or the like, especially for central locking installations on motor vehicles.

From German patent specification No. 2,847,589 a drive device for the fastening mechanism of door locks or the like of a motor vehicle central locking installation is known in which an electric motor linearly displaces a rack, coupled with the fastening mechanism, between a fastening position and an unfastening position. A second electric motor, on the drive-output shaft of which a locking element is seated fast in rotation, pivots the locking element into the path of displacement of a locking hook provided on the rack, and blocks the rack in the fastening position. In the position secured in this manner the fastening mechanism cannot be unfastened by manual actuation of the "fastening knob" provided on the motor vehicle door.

In the known drive device the angle of rotation through which the drive-output shaft of the electric motor driving the locking element rotates between the securing position and the unsecuring position of the locking element is relatively small. Therefore the electric motor must be of relatively stout dimensions. Furthermore jolting in the operation of the motor vehicle leads to the locking element shifting of its own accord and thus fastening or unfastening the rack contrarily to intention.

It is the primary object of the present invention to provide a way of preventing the possibility of the locking elements, which are provided to secure the fastening mechanism of the door lock, shifting themselves unintendedly.

A further object is to be achieved that the drive systems of the operating elements can be of smaller dimensions and nevertheless exert sufficiently high displacement forces upon the locking elements.

It is still a further object of the invention to improve the locking elements so that they withstand even a forceful manual attempt to unfasten the fastening mechanism.

In a first aspect of the invention the fastening mechanism of the door lock is actuated by an operating element which is guided for linear displacement in a housing of the drive device. An operating drive, for example a direct-current motor, drives the operating element, preferably formed as a rack, in both directions of displacement through a toothed-wheel transmission. A locking lever formed for example as locking pawl, which is mounted on the housing for pivoting about an axis extending transversely of the direction of displacement of the operating element, blocks the operating element in the fastening position blocking the fastening mechanism. A rotating drive formed preferably as direct-current motor with permanent-magnet rotor pivots the locking lever, by means of an eccentric drive, between the locking position blocking the operating element and the unlocking position. The eccentric drive effects a power step-up and thus an increase of the angle of rotation of the drive-output shaft of the rotating drive. Thus the rotating drive can be of smaller dimensions. On the other hand it is difficult for the locking lever to shift by reason of jolting. This is true especially if the direct-current motor has a high detention moment.

The eccentric of the eccentric drive co-operates preferably with an aperture of the locking lever. The aperture preferably has abutment faces which limit the angle of rotation of the eccentric. The abutment faces are so arranged that in its end positions allocated to the locking position and preferably to the unlocking position of the locking lever the eccentric is situated in a "beyond dead point" position in which forces acting upon the locking lever press it against the abutment face and not away from the abutment face.

The number of pole pairs of the direct-current motor is made as small as possible in order to achieve defined detent positions of the motor. The detent positions preferably coincide with the end positions of the eccentric.

Under a second aspect of the invention the operating element which actuates the fastening mechanism is actuated by a locking lever the locking surface of which proceeds in circular form and concentrically with the pivot axis of the locking lever. The locking lever is driven by a drive motor on the drive-output shaft of which a toothed wheel is seated which meshes with a toothing of the locking lever which is concentric with the pivot axis. Under this aspect again the toothed gear transmission provides the possibility of making the drive motor of smaller dimensions and better preventing unintended shifting of the locking lever.

The arcuate locking face of the locking lever preferably co-operates with a locking face of the locking element which is curved in the same direction and has the same radius. In this way the area of contact between the locking lever and the locking element can be made relatively large so that relatively great forces can be transmitted, which reliably prevent violent unfastening of the fastening mechanism.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
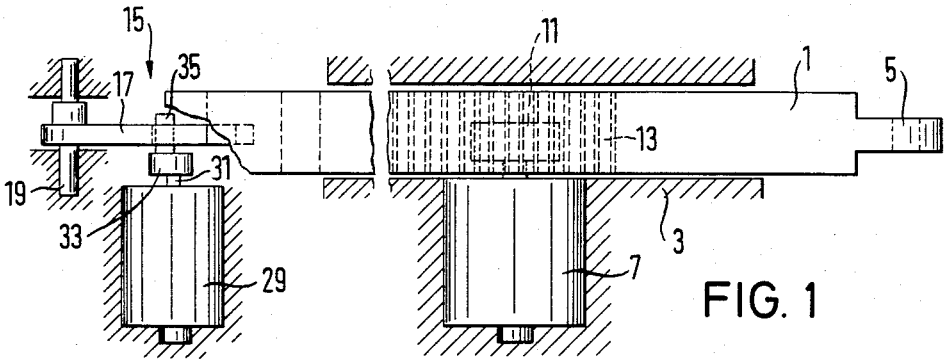
FIG. 1 shows a diagrammatic representation of a drive device for a fastening mechanism of a motor vehicle door lock which can be used in combination with a central locking installation.
Figure 2:
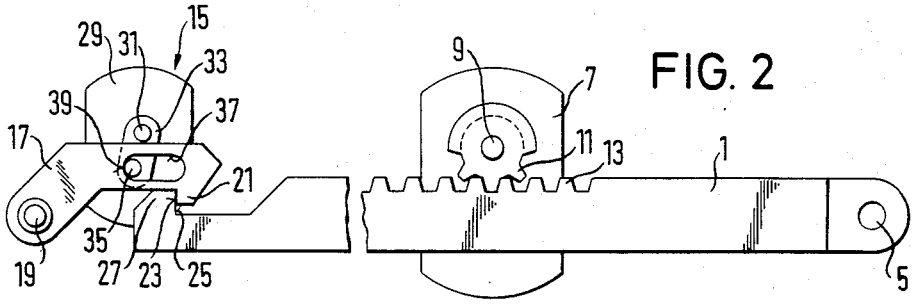
FIG. 2 shows a diagrammatic lateral elevation of the drive device according to FIG. 1 in the secured condition.
Figure 3:
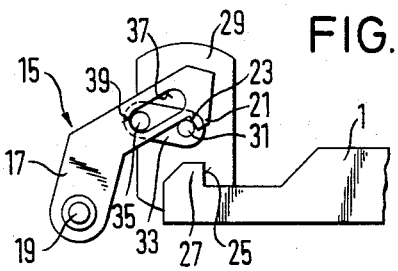
FIG. 3 shows a partial elevation of the drive device as represented in FIG. 2, in the unsecured condition.

FIGS. 1 to 3 show a rack 1 which is linearly displaceable in a housing 3 indicated by hatching. At its end protruding from the housing 3 the rack 1 carries an eye 5 to which the fastening mechanism of a centrally fastenable motor vehicle door lock is coupled through a linkage (not shown further). An electric drive motor 7 secured on the housing 3 carries on its drive-output shaft 9 a pinion 11 which meshes with a toothing 13 of the rack 1 and moves the rack 1 in both directions of displacement between a fastening position represented in FIGS. 1 and 2, fastening the fastening mechanism, and a position unfastening the fastening mechanism. The electric motor 7 is switched on for the fastening stroke or the unfastening stroke by a control circuit known per se (not shown) when one of the door locks, for example the driver's door lock, is locked or unlocked by means of the key.

The door locks of the motor vehicle can be fastened and unfastened manually from the interior of the vehicle, for example by means of "fastening knobs" on the doors. The fastening knobs or the like are coupled with the fastening mechanism for example through a connecting linkage between the rack 1 and the fastening mechanism. For security against unauthorised unfastening of the fastening mechanism the rack 1 is blockable in its fastening position by a locking device 15. The locking device 15 comprises a locking pawl 17 which is mounted on the housing 3 for pivoting about an axis 19 extending perpendicularly of the direction of displacement of the rack 1. At its end remote from the axis 19 the locking pawl 17 carries a hook 21 protruding in the pivoting direction, of which the locking face 23 pointing towards the axis 19 co-operates with an oppositely directed locking face 25 of a hook 27 on the end of the rack 1 opposite to the eye 5.

An electric motor 29 pivots the locking pawl 17 between a locking position as illustrated in FIG. 2, in which the rack 1 is blocked, and an unlocking position as represented in FIG. 3, in which the rack 1 is freely movable by the motor 7. On its drive-output shaft 31 the electric motor 29 carries an eccentric crank 33 the crank arm 35 of which engages in an elongated aperture 37 of slideway type of the locking pawl 17. On rotation of the eccentric crank 33 the crank arm 35 slides in the aperture 37 and pivots the locking pawl 17 between the locking position and the unlocking position.

The end face of the elongated aperture 37 adjacent to the axis 19 forms an abutment face 39 on which the crank arm 35 abuts both in the locking position and in the unlocking position. The eccentric crank 33 can be rotated between its two end positions, fixed by the abutments, over an angle of more than 180°. The abutment face 39 is so arranged that the axis 19, the drive-output shaft 31 and the crank arm 35 lie, in both the locking position and in the unlocking position of the locking pawl 17, on the angles of an obtuse-angled triangle. Thus in its end positions the eccentric crank 33 is situated in a "beyond dead point" position and is pressed against the abutment face 39 when the locking pawl 17 is to be pivoted by external forces, for example jolting or the like, out of the locking position as illustrated in FIG. 2 into the unlocking position or out of the unlocking position as represented in FIG. 3 into the locking position. Thus the fastening device 15 has self-retaining properties.

The electric motor 29 is preferably formed as direct-current motor with permanent magnet rotor and has a low number of pole pairs, preferably a pole pair number of 3. Such electric motors have detent properties in angle positions determined by the pole pair number. The angle of rotation of the eccentric crank 31 is so selected and placed in relation to the aperture 37 that the end position of the eccentric crank 33 fixed by the abutment face 39 in each case coincides with a detent position of the electric motor 29. The detent properties of the electric motor improve the self-retaining properties of the locking device 15.

Figure 4:
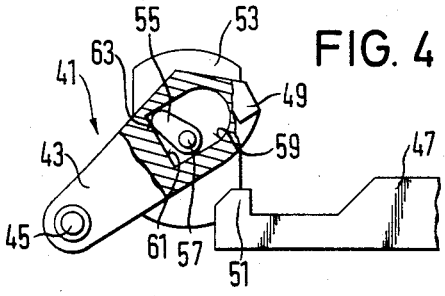
FIG. 4 shows a partial elevation of another form of embodiment of a locking device in the unlocked condition, as it may incidentally be used in the drive device according to FIGS. 1 to 3.

FIG. 4 shows another form of embodiment of a locking device designated generally by 41, which can be used in place of the locking device 15 with the drive device according to FIGS. 1 to 3. The locking device 41 comprises a locking pawl 43 which is mounted on a housing (not shown) pivotably about a spindle 45. A rack 47 coupled with the fastening mechanism is guided for linear displacement in the housing. The locking pawl 43 carries at its free end remote from the spindle 45 a hook 49 which co-operates with a hook 51 of the rack 47, provided on the nearer end of the rack 47 and blocks the rack 47 in the fastening position. The locking pawl 43 is pivoted by an electric motor 53 by means of an eccentric dog 55 between its locking position, in which it blocks the rack 47, and its unlocking position in which it releases the rack 47. The eccentric dog 55 is seated fast in rotation on a drive-output shaft 57, parallel to the spindle 45, of the motor 53 and engages, including the dog end of the drive-output shaft 57, in an aperture 59, formed as slideway guide, of the locking pawl 43. The advantage of this form of embodiment is its short overall length in the direction of the pivot spindle 45.

The manner of function of the drive device according to FIG. 4 corresponds otherwise to the manner of function of the drive device according to FIGS. 1 to 3. More especially the aperture 59 likewise has an abutment face 61 facing away from the spindle 45 and limiting the angle of rotation of the eccentric dog 55, which amounts to more than 180°. When the eccentric dog 55 is in its end positions it is in a "beyond dead point position" in which the spindle 45, the drive-output shaft 47 and the point of contact between the abutment face 61 and the eccentric dog 55, indicated at 63, lie both in the locking position and in the unlocking position of the locking pawl 43, at the angles of an obtuse-angled triangle. The electric motor 53 is again formed as direct-current motor with permanent magnet rotor and has detent positions in the end positions of the eccentric dog 55.

Figure 5:
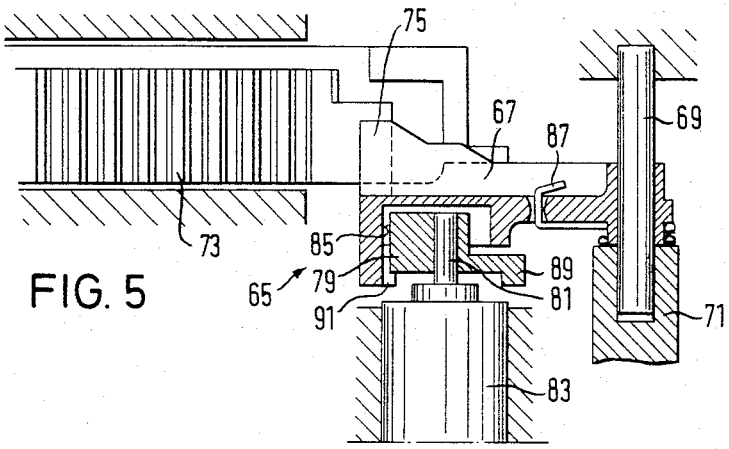
FIG. 5 shows a partial elevation of a further form of embodiment of a locking device such as may incidentally be used in the drive device according to FIGS. 1 to 3.
Figure 6:
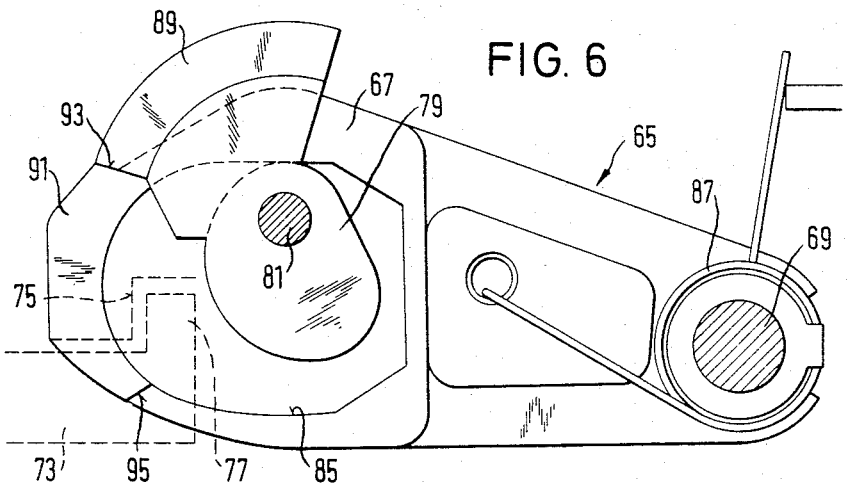
FIG. 6 shows a detail view of the locking device according to FIG. 5 in the locking position.
Figure 7:
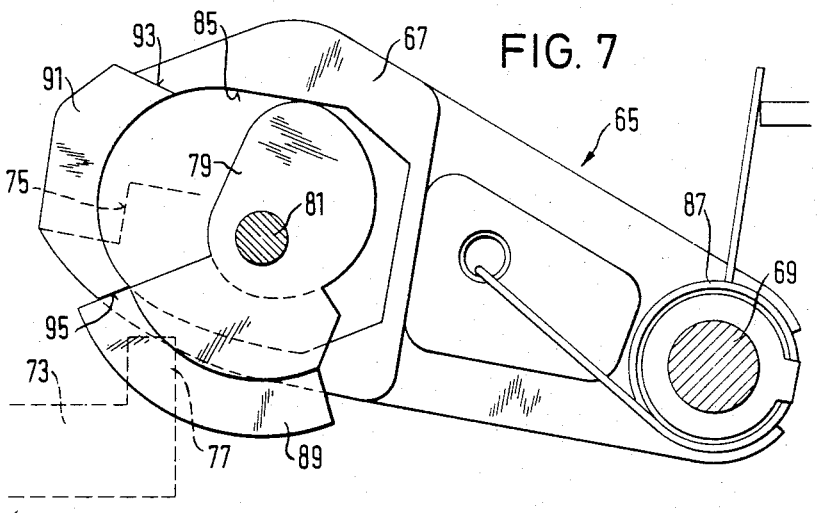
FIG. 7 shows a detail view of the locking elements of the locking device according to FIG. 5, in the unlocking position.

A further embodiment of a locking device, designated in general by 65, as represented in FIGS. 5 to 7 can be used in place of the locking device 41 of the drive device according to FIG. 4. The locking device comprises a locking pawl 67 which is mounted for pivoting about a spindle 69 on a housing indicated at 71. In the housing a rack 73, coupled with the fastening mechanism of the door lock, is guided for linear displacement. As explained in greater detail above, the rack 73 is displaced by an electric motor by means of a pinion meshing with the toothing of the rack 73. At its free end remote from the spindle 69 the locking pawl 67 carries a hook 75 which co-operates with a complementary hook 77 of the rack 73 and blocks the rack 73 in the fastening position. Ihe locking pawl 67 is pivoted by an eccentric dog 79, which is seated fast in rotation on a drive-output shaft 81 of an electric motor 83, out of the locking position as represented in FIG. 6 into the unlocking position as represented in FIG. 7. The eccentric dog 79 is seated in an aperture 85 of the locking pawl 67 which encloses the eccentric dog 79 in annular form. A legged spring 87 braced between the locking pawl 67 and a stop fast with the housing and lopping around the spindle 69 stresses the locking pawl 67 against the eccentric dog 79 in the direction towards the locking position. The legged spring 87 generates the closing force of the locking pawl 67 and prevents it from chattering in operation. In order to counteract undesired rotation of the eccentric dog 79 the latter carries an eccentric counterweight 89 lying diametrically opposite to its eccentric weight but axially outside the aperture 85. Into the path of rotation of the eccentric counterweight 89 there extends a stop nose 91 of the locking pawl 67. The stop nose 91 forms two stop faces 93 and 95 facing away from one another, against which the eccentric counterweight 89 strikes in the two end positions of the eccentric dog 79, that is in the locking position and the unlocking position of the locking pawl 67. The cam form of the eccentric dog 79 in the region of its unlocking angle position is so selected that in the unlocking position it is situated in a beyond-dead-point position. Forces acting in the locking direction upon the locking pawl 67 pivot the eccentric dog 79 and thus the eccentric counterweight 89 against the stop 95 of the stop nose 91. Thus unintentional locking is avoided. The legged spring 87 prevents unintentional unlocking. The electric motor 83 is formed as direct-current motor with permanent magnet rotor. It has a high detent moment and a low number of pole pairs, for example 3. The detent positions of the electric motor 83 correspond to the end positions of the eccentric dog 79.

The drive device as represented in FIGS. 8 and 9 again comprises a rack 101 coupled with the fastening mechanism (not shown further) and guided for linear displacement in a housing 103 indicated by hatching. An electric motor 105, on the drive-output shaft 107 of which a pinion 109 is seated fast in rotation, meshes with a toothing 110 of the rack 101 and shifts the latter between a position fastening the fastening mechanism of the door lock and an unfastening position. To this extent the drive device conforms with the drive devices as explained above.

Adjacent to the end of the rack 101 placed in the housing there is arranged a locking device 111 which comprises a locking lever 113 of sector form which is mounted for pivoting in the housing 103 about a spindle 115 extending perpendicularly of the direction of displacement of the rack 101. The external circumference of the locking lever 113 carries on its side axially facing the rack 101 a flange 117 of annular segment form protruding axially towards the rack 101. The flange 117 has on its side facing the spindle 115 a locking face 119 bent around in circle form concentrically about the spindle 115. The locking face 119 co-operates in the unfastening position of the rack 101 with a locking face 121, pointing away from the spindle 115, of an end hook 123 of the rack 101. The locking face 121 has substantially the same radius as the locking face 119 and encloses the spindle 115 concentrically in circle form.

From the side of the locking lever 113 axially remote from the flange 117 a further flange 125 protrudes axially and is provided on its side facing the spindle 115 with a hollow wheel toothing 127. A pinion driven by an electric motor 129 fast with the housing meshes with the hollow wheel toothing 127. The electric motor 129, which is a direct-current motor with permanent magnet rotor and high detent moment, drives the locking lever 113 in both pivoting directions. Stops (not shown) which can also be arranged especially on the pivot lever 113 and can cooperate with the pinion 131, limit the pivot angle of the locking lever 113. The detent positions of the motor 129 are placed so that they coincide with the locking position and the unlocking position of the pivot lever 113.

By reason of the toothed gearing transmission ratio of the locking device 111 motors of slight dimensions can be used. Furthermore the gearing transmission ratio increases the security against unintentional shifting of the locking lever 113. By reason of the configuration of the locking faces 119, 121 it is possible for high forces to be transmitted between the rack 101 and the locking lever 113, which prevents forced unfastening of the locked drive device.

Figure 8:
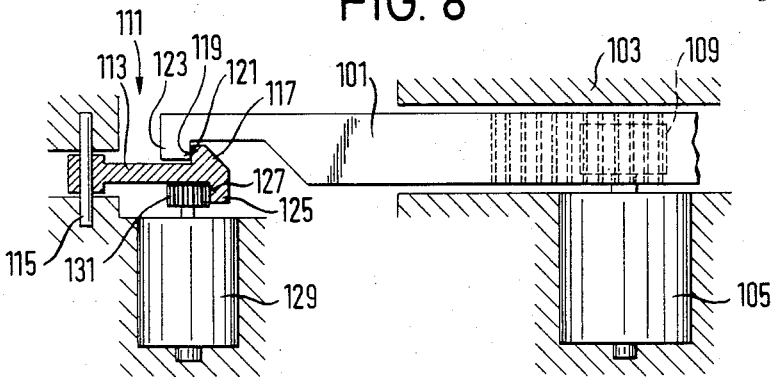
FIG. 8 shows a partially sectional diagrammatic elevation of a further form of embodiment of a drive device for the fastening mechanism of a centrally fastenable motor vehicle door lock.
Figure 9:
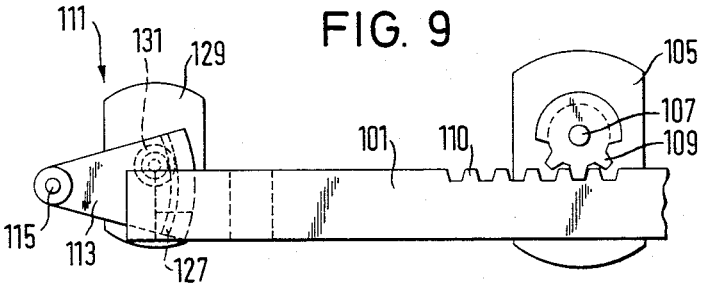
FIG. 9 shows a lateral elevation of the drive device according to FIG. 8.
Figure 10:
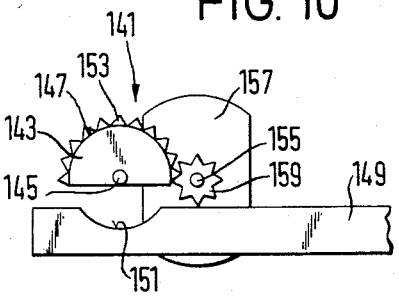
FIG. 10 shows a diagrammatic lateral elevation of locking elements for a drive device similar to the drive device according to FIGS. 8 and 9.

FIG. 10 shows a locking device 141 which can be used in place of the locking device 111 in a drive device according to FIGS. 8 and 9. The locking device comprises a locking segment 143 which is mounted on the housing (not shown in detail) of the drive device, for pivoting about a spindle 145. The locking segment 143 has substantially the form of a half circle sector the circular circumferential section of which forms on a part of its axial depth a smooth locking face 147 which, in the fastening position of a rack 149 coupled with the locking mechanism, is pivotable into an aperture 151 of circle segment form, open to the spindle 145, of the rack 149. The aperture 151 forms a complementary locking face extending concentrically with the spindle 145 in the fastening position, the radius of which face is approximately equal to the radius of the locking face 147. Axially beside the locking face 147 the locking segment 143 carries an external toothing 153 which meshes with a pinion 159 seated on a drive-output shaft 155 of an electric motor 157. The electric motor 157, which again is a direct-current motor with permanent magnet rotor and high detent moment, drives the locking segment 143 in both pivoting directions. Stops (not shown further) limit the pivot angle of the locking segment 143. The detent positions of the electric motor 147 coincide with the end positions, determined by the stops, of the locking segment 143. In this embodiment again the large-area configuration of the locking faces 147, 151 ensures that high locking forces can be transmitted. The gearing transmission ratio prevents unintended displacement of the locking segment 143 and permits the use of motors of relatively slight dimensions.

While specific embodiments of the invention have been shown and described in detail to illustrate the application of the inventive principles, it will be understood that the invention may be embodied otherwise without departing from such principles.

What is claimed is:

1. Drive device for a fastening mechanism of a motor vehicle door lock or the like, comprising:

(a) a housing;

(b) an operating element guided linearly displaceably on said housing between a fastening position and an unfastening position, for said fastening mechanism of said lock, (c) an operating drive driving said operating element in both directions of displacement, (d) a locking lever, a pivot spindle pivotally mounting said locking lever on said housing about an axis extending transversely of the direction of displacement of said operating element, which locking lever in its locking position blocks said operating element in its fastening position and in its unlocking position releases said operating element, (e) a rotating drive held on said housing, a drive-output shaft of which is arranged approximately parallel to said pivot spindle of said locking lever, (f) an eccentric seated fast in rotation on said drive-output shaft of said rotating drive and pivoting said locking lever, (g) said locking lever comprises at least one stop face on which said eccentric and/or a part firmly coupled with it rests in said locking position and in said unlocking position of said locking lever and which limit the rotating movement of said eccentric and in that said eccentric is so formed and arranged that in said locking position and/or said unlocking position of said locking lever it is situated in a beyond-dead-point-position in which forces exerted upon said locking lever in the direction towards its other position in each case press said eccentric or said part coupled with it against said stop faces of said locking lever.

2. Drive device according to claim 1, characterized in that said eccentric is formed as eccentric crank a crank arm of which engages in an aperture of said locking lever.

3. Drive device according to claim 1, characterized in that said eccentric is formed as an eccentric dog engaging in an aperture of said locking lever.

4. Drive device according to claim 2 or 3, characterized in that said stop faces are faces of said aperture which face away from said pivot axis of said locking lever.

5. Drive device according to claim 4, characterized in that the pivot angle of said eccentric between said locking position and said unlocking position of said locking lever is greater than 180°.

6. Drive device according to claim 1, characterized in that a spring initially stresses said locking lever in the pivoting direction against said eccentric.

7. Drive device according to claim 6, characterized in that said spring initially stresses the locking lever towards its locking position.

8. Drive device according to claim 1, characterized in that said eccentric comprises an eccentric counterweight.

9. Drive device according to claim 8, characterized in that said eccentric counterweight is arranged, in the direction of its pivot spindle, beside said locking lever and comprises stop faces facing in the direction of rotation which in said locking position and said unlocking position abut on stop faces of said locking lever.

10. Drive device according to claim 1, characterized in that said rotating drive is formed as a permanent-magnet direct-current motor and in that the angle of rotation of said eccentric between said locking position and said unlocking position of said locking lever is approximately equal to an integral multiple of 360°/2p, wherein p is the number of pole pairs of said direct-current motor.

11. Drive device for a locking mechanism of a motor vehicle door lock or the like, comprising:

(a) a housing, (b) an operating element for said locking mechanism of said lock, guided between a fastening position and an unfastening position for linear displacement on said housing, (c) an operating drive driving said operating element in both directions of displacement, (d) a locking lever mounted on said housing for pivoting about an axis extending transversely of the direction of displacement of said operating element, which locking lever in its locking position blocks said locking element in its fastening position and in its unlocking position releases said operating element, said locking lever having a circular locking face extending concentrically with said pivot axis which locking face in the fastening position co-operates with an oppositely directed locking face, which is curved in the same direction, of said operating element, (e) a drive motor held on said housing, a drive-output shaft of which is arranged approximately parallel with said pivot axis of said locking lever, (f) a toothed wheel seated fast in rotation on said drive-output shaft of said drive motor, which wheel meshes with a toothing of said locking lever concentric with said pivot axis.

12. Drive device according to claim 11, characterized in that said locking faces of said locking lever and of said operating element have substantially equal radii.

13. Drive device according to claim 12, characterized in that said locking face of said locking lever faces radially inwards towards said pivot axis and co-operates with a face of circle arc form, facing away from said pivot axis, of a hook arranged on said pivot axis end of said locking element.

14. Drive device according to claim 12, characterized in that said locking face of said locking lever faces radially outwards away from said pivot axis and co-operates with an arcuate face, curved in said fastening position around said pivot axis, of an aperture of said operating element which is open towards said locking lever.

* * * * *